United States Patent [19]

Theurer

[11] 4,365,918

[45] Dec. 28, 1982

[54] MOBILE RAIL CONTOURING MACHINE

[75] Inventor: Josef Theurer, Vienna, Austria

[73] Assignee: Franz Plasser Bahnbaumischenen Industrieilgesellschaft m.b.H., Vienna, Austria

[21] Appl. No.: 142,441

[22] Filed: Apr. 21, 1980

[30] Foreign Application Priority Data

Aug. 14, 1979 [AT] Austria ..... 5537/79

[51] Int. Cl.[3] ..... B23D 1/20; E01B 31/15

[52] U.S. Cl. ..... 409/296; 51/178; 409/178; 409/339

[58] Field of Search ..... 409/296, 298, 339, 178, 409/180, 337, 338; 51/178; 144/133 B; 29/402.19

[56] References Cited

U.S. PATENT DOCUMENTS

| | | | |
|---|---|---|---|
| 1,025,754 | 5/1912 | Little | 409/337 |
| 1,032,721 | 7/1912 | Woods et al. | 29/402.19 X |
| 1,216,097 | 2/1917 | Eunson | 409/180 |
| 1,759,325 | 5/1930 | Schmidt | 51/178 X |
| 2,398,791 | 4/1946 | Jackson | 409/346 |
| 2,779,141 | 1/1957 | Speno, Jr. et al. | 51/178 |
| 3,823,455 | 7/1974 | McIlrath et al. | 51/178 X |
| 3,978,746 | 9/1976 | Kuchuk-Vatsenko et al. | 409/498 |
| 4,050,196 | 9/1977 | Theurer | 51/178 |
| 4,074,468 | 2/1978 | Panetti | 51/178 |
| 4,115,857 | 9/1978 | Panetti | 51/178 X |

FOREIGN PATENT DOCUMENTS

| | | |
|---|---|---|
| 1083378 | 9/1967 | United Kingdom . |
| 1558843 | 1/1980 | United Kingdom . |

*Primary Examiner*—Z. R. Bilinsky
*Attorney, Agent, or Firm*—Kurt Kelman

[57] ABSTRACT

Rail heads are contoured with a mobile machine moving continuously along a track and comprising a frame and a rail contouring tool mounting linked to the frame. The mounting is adjusted vertically relative to the running surface of the rail head and pressed thereagainst, and guided along the rail head by a guide roller laterally guiding the mounting along a selected side of the rail head and two additional guide rollers vertically guiding the mounting along the running surface of the rail head. A rail contouring tool head including a tool holder is mounted on the mounting for displacement relative thereto and a rail contouring tool is replaceably mounted in the tool holder and detachably carries a cutting blade having a cutting edge for planing a selected profile of the rail head by the forward thrust of the machine.

19 Claims, 17 Drawing Figures

XIV
XV
XVI
10(11)
4(5)
45°

MOBILE RAIL CONTOURING MACHINE

The present invention relates to a mobile rail contouring machine mounted on a railroad track for continuous movement in an operating direction, the track including two rails each having a rail head defining a gage side, a field side and a running surface, and the machine being arranged for continuously removing such running surface irregularities as ripples, corrugations and overflow metal during the continuous movement.

Known machines of this type comprise a frame, a rail contouring tool mounting linked to the frame, drive means for vertically adjusting the mounting relative to the running surface of the rail head of a respective rail and for pressing the mounting thereagainst, the mounting being guided vertically and laterally along the sides and the running surface of the rail head, a rail contouring tool head including a tool holder arranged on the mounting and a rail contouring tool mounted on the tool holder. The rail contouring tool may be a rotary grinding disc or a whetstone and, where it was desired to remove the irregularities to a greater depth, a planing tool including a cutting blade.

German Pat. No. 905,984, published Mar. 8, 1954, discloses a vise clamped to a rail at a rail joint and carrying a mechanism including a tool head mounting a tool for milling the welded joint. The tool head is cranked back and forth along the running surface of the rail head to plane the joint. This device is only useful locally at respective rail joints and cannot be used for the continuous contouring of a rail of a railroad track. It is also complex in construction and use, for all of which reasons it has found no practical application.

U.S. Pat. No. 4,295,764, filed Dec. 11, 1978 and granted Oct. 20, 1981, discloses a mobile rail contouring machine with a plurality of mountings vertically adjustably connected to the machine frame and vertically and laterally guided along the rail, each mounting carrying a number of cutting blades or whetstones. The mounting with the cutting blades affixed thereto is vertically adjustable relative to the flanged wheels supporting it on the rail so as to position the cutting blades in relation to the running surface of the rail head for milling it. The mountings associated with each rail are linked together by a hydraulic cylinder-piston unit for spreading the mountings and blocking them in position. This arrangement made it possible for the first time to obtain the continuous removal of irregularities from the running surface of the rail head with cutting or planing tools at high efficiency but it was not always possible to achieve accurate contouring to the desired profile. In addition, centering of the contouring tools and setting them properly in relation to the surface to be milled was often difficult.

It is the primary object of this invention to provide a mobile rail contouring machine and method for continuously removing such running surface irregularities as ripples, corrugations and overflow metal during the continuous movement of the machine along a railroad track, in which the rail contouring tool mounting is guided with high precision and the contouring tools may be set with high accuracy in relation to the rail head surface to be milled thereby so as to improve the quality of the contouring work while increasing the efficiency of the work and the useful life of the cutting blades. With the rail contouring machine, method and tool of the invention, track rails may be uniformly restored to their original contours in a continuous operation along long streches of track.

The above and other objects are accomplished according to the invention with a mobile rail contouring machine comprising a frame, a rail contouring tool mounting linked to the frame, and a drive means for vertically adjusting the mounting relative to the running surface of the rail head of one of the rails and for pressing the mounting thereagainst. Guide roller means guide the mounting vertically and laterally along the rail head and this means includes a guide roller laterally guiding the mounting along a selected side of the rail head and two additional guide rollers vertically guiding the mounting along the running surface of the rail head, the additional guide rollers each having an axis extending substantially parallel to the track plane. A rail contouring tool head including a tool holder is mounted on the mounting for displacement in relation thereto, and a rail contouring tool is replaceably mounted in the tool holder. The tool detachably carries a cutting blade having a cutting edge for planing a selected profile of the rail head.

Specifically, the present invention provides a mobile rail planing machine comprising a frame, a rail planing tool mounting linked to the machine frame in association with each rail, the mountings being in substantial alignment in a direction extending transversely to the rails, transversely extending spacing members linking the mountings to each other, hydraulic drives for continuously adjusting the spacing members and the mountings linked thereto to the track gage, and drive means for vertically adjusting the mountings relative to the running surface of the rail head of the associated rail and for pressing the mountings thereagainst. Guide roller means guide the mountings vertically and laterally along the respective rail heads and these means include two guide rollers laterally guiding each mounting without play along a selected side of the rail head of the associated rail and a plurality of additional guide rollers vertically guiding each mounting along the running surface of this rail head, the additional guide rollers each having an axis extending substantially parallel to the track plane. A tool head including a tool holder is mounted on each mounting centrally between the guide rollers and for displacement in relation to the mounting in planes parallel to the track plane and to a vertical plane passing through the associated rail, and hydraulic drives are connected to each tool head for displacing the same in these planes. A rail planing tool is replaceably mounted in each tool holder and detachably carries a cutting blade having a cutting edge for planing a selected profile of the rail head.

Such surface irregularities as ripples, corrugations and overflow metal are removed from a rail head defining a gage side, a field side and a running surface during, and by the forward thrust of, the rail contouring machine having a frame mounted on a railroad track for continuous movement in an operating direction. The machine comprises a rail contouring tool mounting linked to the frame, guide roller means for vertically and laterally guiding the mounting along the rail head, the guide roller means including guide rollers laterally guiding the mounting along a selected side of the rail head and vertically guiding the mounting along the running surface of the rail head, a single rail contouring tool head mounted on the mounting for lateral and vertical displacement in relation thereto, and a rail contouring tool carrying a cutting blade mounted in the tool head. The mounting is pressed laterally against the side of the rail head opposite the side from which the surface irregularities are to be removed and against the running surface of the rail head, and is simultaneously moved continuously along the rail with a force of a sufficient thrust to remove a continuous chip or shaving off the rail head.

The rail contouring tool is replaceably mounted in a tool holder carried by a mobile rail contouring machine mounted for continuous movement in an operating direction for continuously planing a rail head during the continuous movement, the tool being arranged symmetrically with respect to a vertical center plane passing through the rail head and detachably carrying a cutting blade having a cutting edge arranged to engage a selected surface of the rail head for planing a selected profile of the rail head.

The arrangement of this invention has made it possible for the first time to machine the surface of a rail head of a rail on a laid railroad track, and particularly the running surface of the rail head, in a continuous manner substantially as accurately as has heretofore been achieved with stationary vises clamped to a rail and holding a planing tool. The machine of the invention has made it possible to plane a rail head in a single pass substantially to its original profile. The greatly increased accuracy in the guidance of the rail contouring tools and their setting according to selected references provided by the guide roller means makes it possible to remove all types of surface irregularities substantially completely, including long and short undulations or ripples as well as overflow metal, by suitable profiling or planing of the rail head.

The rail contouring tools enable the rail head profile to be restored with the use of a relatively short reference basis and ripples or undulations to be removed from the running surface with the use of a relatively long reference basis, while permitting any surface irregularities due to manufacturing errors or wear to be removed with cutting blades of selected configurations.

The above and other objects, advantages and features of this invention will become more apparent from the following detailed description of certain now preferred embodiments thereof, taken in conjunction with the accompanying partly schematic drawing wherein FIG. 1 is a side elevational view of a first embodiment of the mobile rail contouring machine of the invention;

Figure 1:
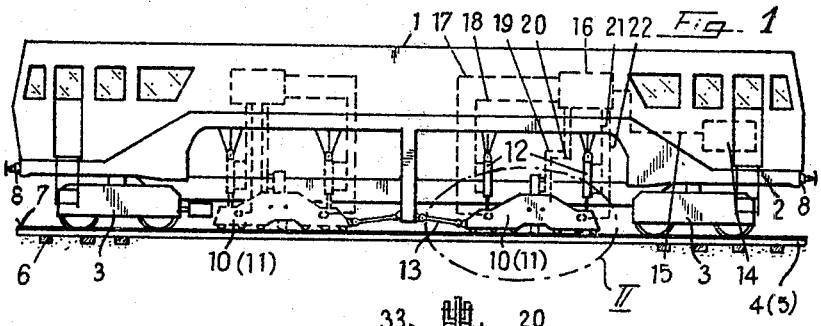
Figure 2:
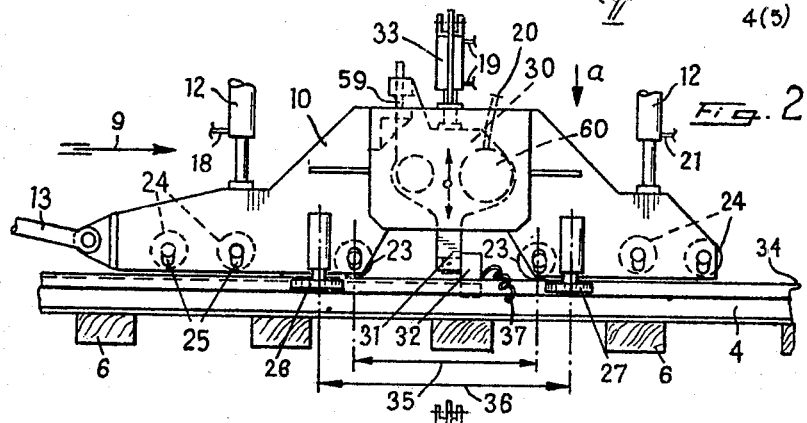
FIG. 2 is a like but enlarged view of the rail contouring tool mounting in one operating mode.
Figure 3:
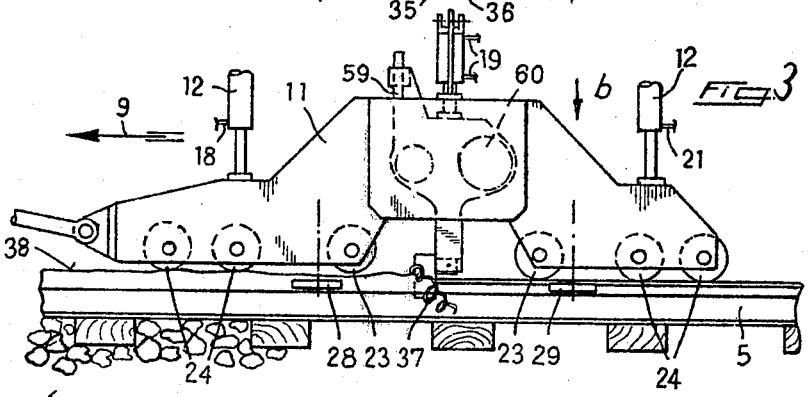
FIG. 3 shows the same view of the mounting in another operating mode.

Referring now to the drawing and first to FIG. 1, there is shown mobile rail contouring machine 1 mounted on railroad track 7 for continuous movement in an operating direction indicated by arrow 9 (see FIGS. 2 and 3). The track includes ties 6 to which are fastened rails 4 and 5 each having a rail head 42 (see FIGS. 5–11) defining gage side 43, field side 44 and running surface 53. The machine is arranged for continuously removing such running surface irregularities as ripples or undulations, corrugations and overflow metal 34 during the continuous movement in the operating direction.

Rail contouring machine 1 comprises frame 2, rail contouring tool mounting 10, 11 linked to the frame, and drive means constituted by hydraulic cylinder-piston motors 12 for vertically adjusting each mounting relative to the running surface of the rail head of an associated one of the rails and for pressing the mounting thereagainst. Machine frame 2 has couplings 8, 8 at respective ends thereof to enable the frame to be incorporated into a train for movement between working sites over long distances and/or for coupling together a plurality of the machine frames to constitute a work train for contouring the rails of a track. The machine also preferably has its own drive to be self-propelled in a selected operating direction along the track, running on two undercarriages 3, 3 which are shown as double-axled swivel trucks. Connecting rod 13 extending in the direction of track 7 links one end of each mounting to machine frame 2 and the cylinder-piston motors 12 are capable of vertically adjusting the mounting and to exert a vertical loading force thereon.

Central power plant 14 is mounted on the machine frame, the power plant including, for example, a fluid pressure generator and an electric generator coupled to a Diesel motor. Furthermore, operating connection 15 connects the central power plant to control 16 for remote control of the various machine operations, conduits 18 and 21 connecting the cylinder chambers of motors 12 to the control and further conduits 19, 20 and 22 connecting the control to other mechanisms to be described hereinafter.

As indicated in full lines in FIG. 1, mobile machine 1 is equipped with a single rail contouring tool mounting associated with each one of the rails or a pair of such mountings each associated with each one of the rails, as shown in broken lines, if the machine frame is heavy enough, the two mountings being symmetrically arranged with respect to the longitudinal center of the machine.

FIG. 2 shows mounting 10 which is visible in the side elevation of FIG. 1 and is associated with rail 4 while FIG. 3 shows mounting 11 associated with rail 5. As shown in FIGS. 2 and 3, guide roller means for vertically and laterally guiding each mounting along one of the rails includes a guide roller 26, 27, 28, 29 laterally guiding the mounting along a selected side 43, 44 of rail head 42 and two additional guide rollers 23 vertically guiding the mounting along running surface 53 of the rail head, the additional guide rollers each having an axis extending substantially parallel to the track plane transversely of the track. In the illustrated embodiment, two guide rollers 26, 27 and 28, 29 laterally guide each mounting 10 and 11.

The two additional guide rollers in the illustrated guide roller means are spaced apart in the direction of the track by a distance not exceeding about half the gage of the track and a respective guide roller 26, 27, 28, 29 is associated with each additional guide roller 23. In this arrangement, the guide rollers cooperate to constitute a rigid reference for planing overflow metal 34 (see FIG. 5) at a side 43 of the rail head opposite selected side 44 which is engaged by guide roller 26, 27 for laterally guiding the mounting along the selected side. Rail contouring tool head 30 is mounted on the mounting 10, 11 substantially centrally between the two additional guide rollers 23. This very simple structure provides a very rigid vise for the rail contouring tool and may be subjected to relatively high loads for effective operation of the planing tool. The centering of the tool head between the relatively closely spaced guide rollers enables the cutting blade to be applied to the rail accurately and without play, the cutting blade being rigidly held on the mounting by the tool head in whose holder the blade is mounted. In this manner, the original rail head profile may be accurately restored by first planing the over-flow metal and then suitably machining the rail head to assume the original profile. In view of the shortness and rigidity of the reference basis provided by the guide rollers, this construction has the additional advantage of making it possible to provide recesses in the mounting to make the tool holder readily accessible for replacement of the tools and cutting blades. Generally, the spacing between the guide rollers wherebetween the tool head is mounted will be about 700 mm.

As shown, a respective pair of guide rollers 26, 28 and 27, 29 is associated with each additional guide roller 23, one of the guide rollers of each pair being arranged for laterally guiding the mounting along a respective rail head side 44 and 43 so that the arrangement may be used in opposite operating directions for working on the rail head side opposite the side along which the mounting is guided.

In the preferred illustrated embodiment, the guide roller means comprises further additional guide rollers 24 spaced from each of one additional guide rollers 23 and including two outermost further additional guide rollers, outermost further additional guide rollers 24 being spaced apart in the direction of the track by a distance not exceeding about the length of track ties 6. The further additional guide rollers are mounted for selected positioning retracted from, and in engagement with, the running surface. In FIG. 2, further additional guide rollers 24 are shown in the retracted position while FIG. 3 shows them in the engaged position wherein the guide rollers cooperate to consitute an elongated rigid reference for planing ripples or corrugations. As shown, the axles of rollers 24 are mounted in elongated slots 25 in mounting 10, 11 to enable them to be selectively positioned in relation to running surface 53 of the rail head.

The long rigid reference basis enables the machine to plane elongated undulations or ripples in the rail head running surface and to remove the same in the form of continuous chip or shaving 37 as the machine moves along the track, the rail head being preferably restored to its original profile at the same time. The usual distance between the two outermost further additional guide rollers 24 will be about 2 m. This enables the length of the reference to be adjusted widely to the length of the ripples to be removed by selectively positioning respective further additional guide rollers 24. Guide rollers 26 to 29 are disc-shaped rollers rotating about vertical axes.

As shown in the drawing, rail contouring tool head 30 including downwardly projecting tool holder 31 is mounted on mounting 10, 11 for displacement in relation thereto in planes parallel to the track plane and to a vertical plane passing through the associated rail. For this purpose, hydraulic cylinder-piston drive motor 33 vertically movably connects tool head 30 to the mounting and conduits 19 connect the cylinder chambers of the drive motor to control 16 for displacing the tool head vertically, limit stop means 59 limiting the vertical stroke of the tool head. Tool head 30 is laterally displaceable in relation to the mounting by hydraulic cylinder-piston drive motor 60 whose cylinder chambers are connected to control 16 by conduits 20. Any suitable guide means, such as guide columns, dove-tailed guide tracks and the like, may mount the tool head on the mounting for vertical and horizontal displacement thereof. The specific displacement means are not part of the present invention as long as the tool head may be displaced in relation to the mounting to assume a desired operating position assuring the desired cutting depth of the cutting blade. Rail contouring tool 32 is replaceably mounted in tool holder 31 and the tool detachably carries cutting blade 48, 54, 56 (FIGS. 5 to 11) having a cutting edge for planing a selected profile of rail head 42.

In the retracted position of further additional guide rollers 24 shown in FIG. 2, the machine is adapted for removal of overflow metal 34 produced by prolonged train traffic and for machining gage side 43 of the rail head, which require only short reference 35 provided by the two engaged additional guide rollers 23 while all the further additional guide rollers 24 are out of contact with the running surface of the rail head. Distance 36 between the vertical axes of guide roller pairs 26, 28 and 27, 29 is also relatively small, averaging maybe about 700 mm. With this arrangement, irregularities having a wavelength of up to about 30 cm can be readily removed. As is shown in FIGS. 5 to 8, rail contouring tool 32 is positioned opposite the rail head side engaged by the lateral guide rollers so that the latter serve as a support for absorbing the lateral cutting forces. As the machine advances continuously, the cutting blade will machine a continuous chip or shaving 37 off the rail head, the mounting being continuously moved along the rail by the machine with a sufficient thrust to plane the rail head while the mounting is pressed thereagainst.

When the machine is used to remove relatively short ripples 38, as illustrated in FIG. 3, the mounting is laterally guided by guide rollers 28, 29 along gage side 43 of rail head 42 and a longer reference basis is provided by lowering further additional guide rollers 24 into engagement with the running surface of the rail head. Obviously, a larger number of vertical guidance rollers could be provided and any selected number of guide rollers 24 may be retracted to adapt the length of the reference to the length of the ripples or other irregularities to be removed and to avoid copying such surface irregularities in case the wheel base of the mounting accidentally coincides in length with the length of such irregularities. While undulations 38 are planed, other rail head profiling may be produced by the cutting blades. Whether such simultaneous profiling work may be produced with a suitable cutting blade arrangement will depend primarily on the degree of wear of the rail head.

Figure 4:
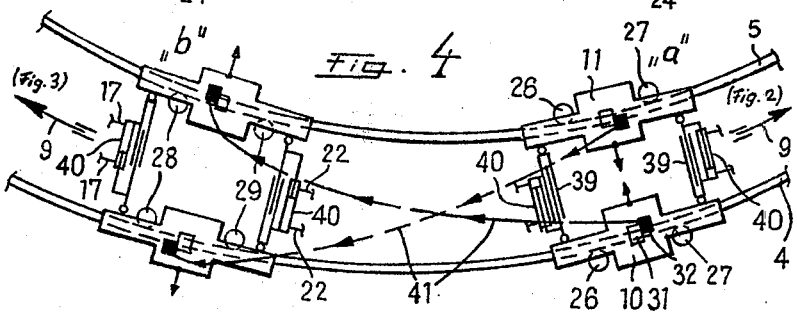
FIG. 4 is a top view of the mountings of FIGS. 2 and 3.

FIG. 4 illustrates the operation of rail contouring machine 1 of FIGS. 1 to 3 in a track curve and in opposite operating directions, advancing to the left with the arrangement of FIG. 3 and to the right with the arrangement of FIG. 2. As schematically indicated in FIG. 4, a mounting 10, 11 is linked to the machine frame in association with each rail 4, 5. A tool head 30 is arranged on each mounting and a single tool 32 carrying a single cutting blade is mounted in each tool holder 31. Mountings 10, 11 are in substantial alignment in a direction extending transversely to the rails and transversely extending spacing members 39 continuously adjustable to the track gage by hydraulic cylinder-piston drive motors 40 link the mountings to each others preferably by means of universal joints. Double-acting drive motors 40 are connected by conduits 17 and 22 to control 16 for operation. These motors enable the operator of the machine, depending on the selected rail contouring operation, to apply hydraulic pressure to a selected cylinder chamber of the drive motor to press guide roller 26, 27 of mountings 10, 11 against field sides 44 of rails 4 and 5 (right side of FIG. 4) or to press guide rollers 28, 29 against gage sides 43 of the rails (left side of FIG. 4). In both selected positions, the mountings are pressed without play against the track rails to follow the curve and, at the same time, their transverse spacing is adjusted to a changing track gage in the curve.

With a given machine weight, such a tool arrangement produces a very high rail planing force and efficiency, the adjustable spacing members linked universally to the mountings assuring at the same time that, despite the very high operating stresses, the tools are always held in a rigid vise during the cutting operation. When the weight of the machine is, for example, about 40 tons, a sufficient thrust can be reached to produce cutting forces for removing a continuous chip or shaving of a gage of the magnitude of about 0.5 mm and more as the cutting blade planes the rail head during the continuous advance of the machine along the track.

The right side of FIG. 4 shows the arrangement and operation according to FIG. 2 and planing tools 32 are mounted at the front of tool holder 31, as seen in the operating direction indicated by arrow 9. At the left side, the arrangement and operation according to FIG. 3 is illustrated for operating in the opposite direction. This change is accomplished very simply by proceeding in the manner indicated by arrows 41 to reposition tools 32, motors 40 being operated in the opposite direction to engage guide rollers 28, 29 instead of rollers 26, 27.

As shown, tool holder 31 is symmetrically constructed with respect to a plane extending vertically to the track and perpendicularly to the rail whereby a respective tool may be operative in a respective operating direction of the machine. This makes it possible to use the same tool on the machine for operation in both directions along the track, requiring merely the repositioning of the tool in the holder. A few typical embodiments of rail contouring tools useful for the machine to remove surface irregularities from rail heads in a continuous planing operation are illustrated in FIGS. 5 to 11.

Figure 5:
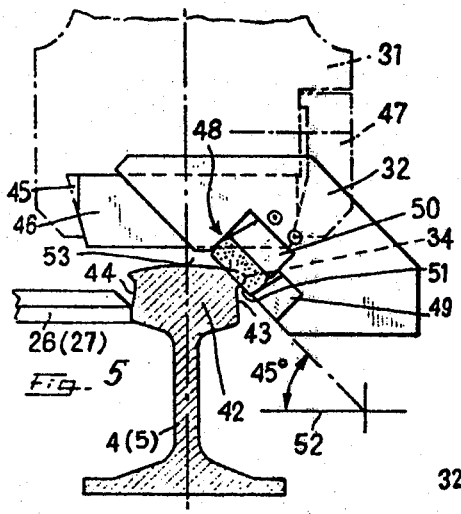
FIGS. 5 to 11 show enlarged end views of different embodiments of rail contouring tools according to the present invention for producing different profiling operations.

Referring to FIG. 5, tool holder 31 is shown to guide 45 which is a recess of dove-tailed cross section defined in the tool holder and extending in the direction of the track. Tool part 46 is replaceably received by dovetailed guide recess 45 and clamping plate 47 holds tool part 46 attached to the guide. This provides a very simple construction for the rapid replacement of the planing tool while, at the same time, assuring a very rigid and secure mounting of the tool in the holder. Furthermore, after the tool holder has been suitably centered, for example with respect to the center line of the track, the tool may be replaced without the need for repositioning the tool holder. Even if the tool is not precisely set in longitudinally extending guide 45, this has no effect on the accuracy of the planing operation since the latter depends solely on the accuracy of the lateral positioning of the cutting edge in relation to the rail head.

As shown in FIGS. 5 to 11, planing tool 32 is arranged symmetrically with respect to vertical center plane 55 passing through rail head 42 and detachably carries cutting blade 48, 54, 56 having cutting edge 51, 57 arranged to engage a selected surface of rail head 42 for planing a selected profile of the rail head. Such a tool can be used for the successive and complete restoration of the original profile of a rail head and all that is required is to replace respective tools in the tool holder for successive planing operations as described hereinbelow.

FIG. 5 shows a tool arrangement for planing overflow metal 34 from gage side 43 of rail head 42. In this case, guide rollers 26, 27 are engaged with field side 44 of the rail head for guiding tool holder 31 without play along the rail. Cutting blade 48 is made of a highly resistant material, such as carbide steel, and is replaceably mounted in the tool holder, being held in tool 32 by wedge 49 and clamping shoes 50 to enable the cutting blade to be readily replaced in the tool. Cutting edge 51 of cutting blade 48 is arranged to extend at an angle of 45° with respect to vertical center plane 55 and plane 52 extending parallel to the plane of the track. The cutting edge is substantially rectilinear. This arrangement permits the removal of relatively much overflow metal and rectilinear cutting edges can be readily sharpened. As will be appreciated from the drawing, the removal of overflow metal 34 will produce a sharp edge in the transition between running surface 53 and gage side 43 of rail head 42. This will be properly contoured in a subsequent planing operation, as will be described hereinafter.

Figure 6:
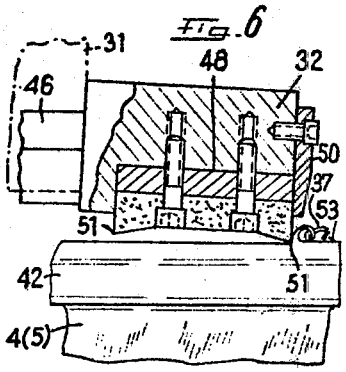

In the embodiment shown in partial longitudinal section in FIG. 6, cutting blade 48 is detachably affixed to planing tool 32 by screws and is comprised of a carbide metal platelet having two edges 51 at respective ends thereof, the platelet extending in the direction of rail head 42 and cutting edges 51 extending transversely thereto. As shown, the tool is slightly inclined with respect to running surface 53 of the rail head so that only the front cutting edge engages the running surface to remove continuous chip or shaving 37 therefrom during operation of the machine. When this cutting edge is worn, the cutting blade is simply reversed in the tool so that the sharp edge engages the running surface. This in practice doubles the life of the blade when the two cutting edges 51 are of the same configuration. On the other hand, if they are of different configurations, reversal of the cutting blade makes it possible to use the same blade for two machining operations producing different configurations.

Figure 7:
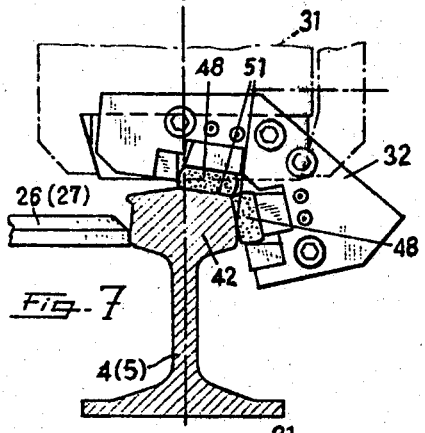

FIG. 7 shows an embodiment wherein planing tool 32 carries two cutting blades 48 at one side of vertical center plane 55. Cutting edge 51 of one cutting blade is arranged to extend at an angle of about 22.5° and the cutting edge of the other blade is arranged to extend at an angle of about 67.5° with respect to the vertical center plane, cutting edges 51, 51 enclosing an angle of about 135° and being substantially rectilinear. This tool is preferably used after overflow metal 34 has been removed with the tool illustrated in FIG. 5 so that any edges remaining after the preceding planing operation are machined by the deeper milling of the surface regions adjacent the overflow metal. At the same time, gage side 43 and half of running surface 53 of rail head 42 are planed.

Figure 8:
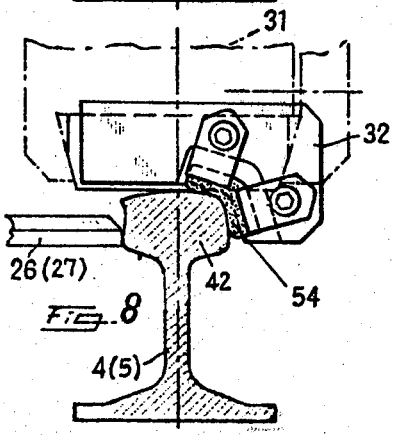
Figure 11:
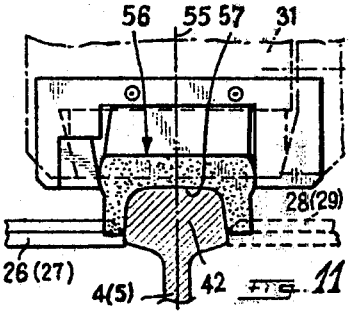

Cutting blade 54 of tool 32 of FIG. 8 has a cutting edge with a curvature substantially corresponding to the original profile of a respective side of rail head 42 including an arcuate transition region between the rail head side and the running surface of the rail head as well as an adjacent portion of the running surface. When this tool is used subsequently to the tools of FIGS. 5 and 7, the original profile of one half of the rail head is fully restored.

According to a preferred embodiment of the method of the present invention, mounting 10, 11 is continuously moved along a section of associated rail 4, 5 in three successive operating stages. Tool head 30 is displaced at the beginning of each operating stage into engagement with the rail head surface and the operating stages successively comprises a first stage for removing overflow metal 34 at gage side 43 of rail head 42 opposite field side 44 against which the mounting is pressed. Cutting blade 48 of FIG. 5 is used in this first stage and its cutting edge 51 removes the overflow metal in a continuous chip or shaving. In a second stage, ripples or corrugations are removed from the surface and gage side 43 during a continuous return movement along this rail section with two cutting blades at this side of vertical center plane 55, arranged in the manner shown in FIG. 7. In a third stage, contouring of one half of the rail head surface is finished with cutting blade 54 shown in FIG. 8.

This three-stage contouring method enables the surface of a rail head of a laid rail to be restored to an excellent operating contour in a relatively short time, the cutting blades being changed between the operating stages one of which is effected during the return movement over the track section at which the overflow metal has been removed from the rail heads. If both rails of the track are contoured at the same time in each operating stage, the contoured rails may be removed after the planing operation has been completed and these contoured rails may be exchanged in the track whereby the contoured field sides of the rails become the gage sides engaged by the flanges of the wheels of railroad cars traveling thereover.

In track curves, extensive and expensive restoration work is avoided according to another preferred aspect of the method according to this invention by pressing one of the mountings of the machine against the gage side of one of the rails with which it is associated while the other mounting is pressed against the field side of the other rail for simultaneously removing the surface irregularities at the field side of the one rail and the gage side of the other rails, as shown in FIG. 4.

Figure 9:
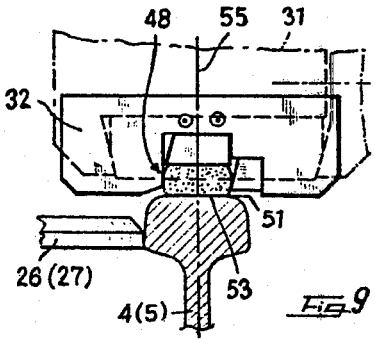

In the tool of FIG. 9, cutting edge 51 of blade 48 is arranged to extend substantially perpendicularly to the vertical center plane of the rail head and is substantially bisected thereby, the cutting edge being substantially rectilinear. This tool will be particularly useful in removing such running surface irregularities as ripples or undulations.

Figure 10:
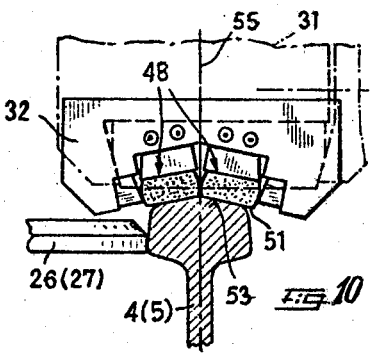

FIG. 10 shows a tool carrying two cutting blades 48, 48 arranged symmetrically with respect to vertical center plane 55 and the plane passing centrally therebetween. Cutting edges 51 of the cutting blades are arranged to extend at an angle of about 15° with respect to the vertical center plane and are substantially rectilinear. This tool enables the entire running surface 53 of the rail head to be planed as a stage before the full restoration of the original rail head configuration which may be accomplished with the tool illustrated in FIG. 11. With this tool, the original rail head configuration is restored after the rail head has been machined with one or more of the tools described hereinabove, cutting blade 56 having cutting edge 57 substantially corresponding to the profile of rail head 42 including the running surface and the sides thereof as well as the transition regions between the running surface and the sides. In this final operating stage and as shown in broken lines, guide rollers 26, 27 as well as guide rollers 28, 29 may be engaged with the sides of the rail head. This produces a particularly exact guidance and centering of cutting blades 56 with respect to vertical center plane 55 of rail head 42.

Figures 12, 13, 14, 15, 16, 17:
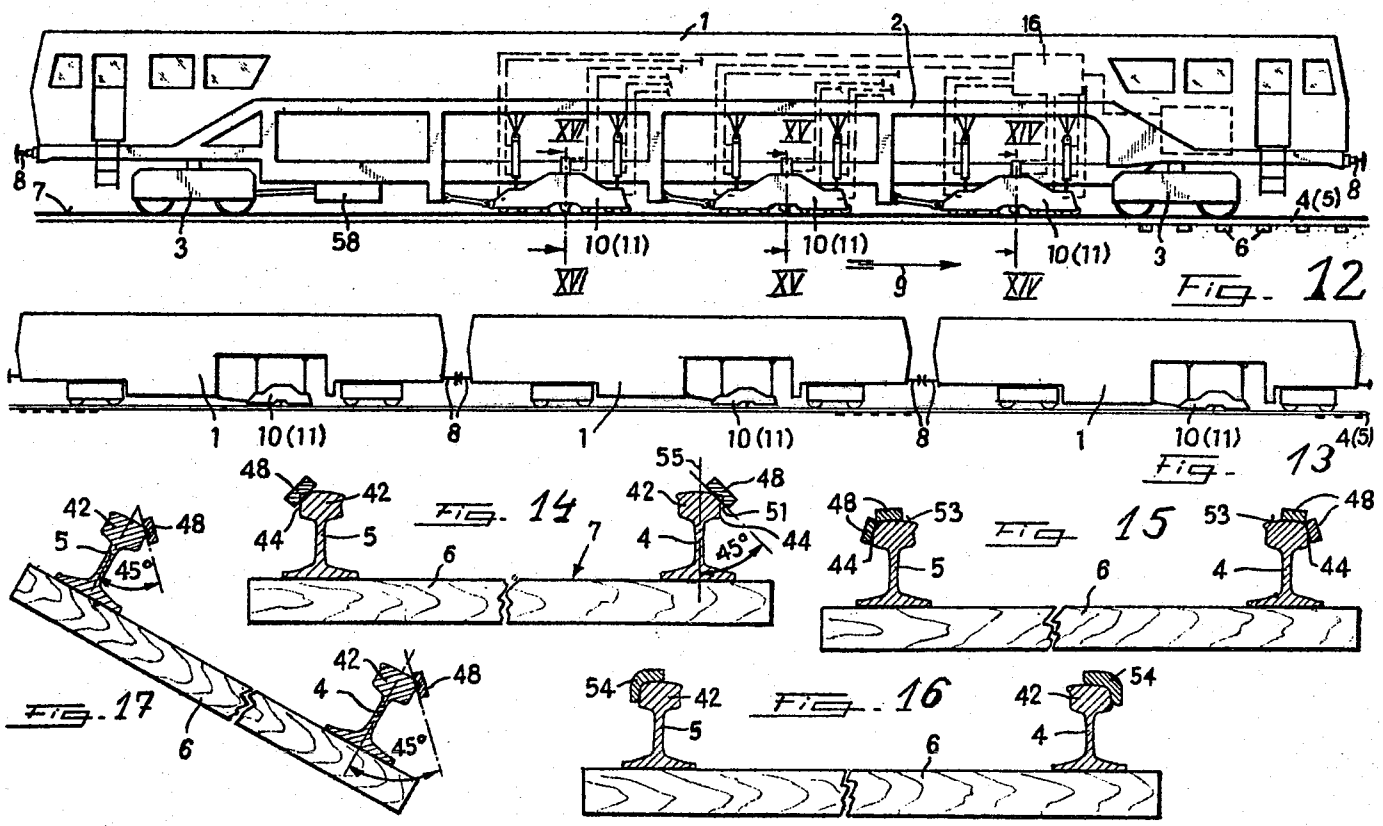
FIG. 12 is a side elevational view of another embodiment of a mobile rail contouring machine.
FIG. 13 is a diagrammatic side view of a train of rail contouring machines according to yet another embodiment.
FIGS. 14 to 16 are diagrammatic sections along lines XIV—XIV, XV—XV and XVI—XVI, respectively, of FIG. 12.
FIG. 17 is a like section of a tool arrangement set for working on the rail heads of a superelevated track curve.

FIG. 12 illustrates an embodiment of a rail contouring machine 1 with frame 2 having a weight of the order of magnitude of the weight of a mobile track surfacing machine, for instance in excess of 45 tons. The machine is self-propelled, being equipped with drive 58 capable of a substantial thrust to move the machine along the track during the planing operation. The machine is substantially similar to that of FIG. 1 but comprises a plurality of mountings 10, 11 linked to the machine frame in association with each rail 4, 5, three such mountings being used in the preferred illustrated embodiments. Respective pairs of mountings 10, 11 are in substantial alignment in a direction extending transversely to the rails and transversely extending spacing members, as shown in FIG. 4, link the mountings of each pair to each other. The spacing members are continuously adjustable to the track gage. As in the embodiment of FIG. 1, all the drives on the mountings are connected to central control 16 for remote control thereof. The operation of this machine will be described hereinafter in connection with FIGS. 14 to 17. With a heavy machine of this type, it is possible to obtain high machining efficiencies while the mountings are clamped to the track rails as rigid vises in tight engagement with the track rails at any track gage. Continuous chips or shavings of 0.5 mm gage and more have been obtained with such machines. The configuration of the rail heads of a track may be fully restored with this machine in one or two passes.

FIG. 13 shows a train of three mobile rail contouring machines 1 coupled together by couplings 8 for common continuous movement. The frame of each machine is relatively heavy, having a weight of the order of magnitude of the weight of mobile track surfacing machines. Each machine has a single mounting 10, 11 linked to the machine frame in association with each rail 4, 5, substantially as shown in full lines in FIG. 1 and fully described hereinabove. The rail contouring tool of each machine carries a different one of the cutting blades, such as illustrated in FIGS. 5 to 11, respectively designed for contouring the rail head or planing corrugations in a single pass of the train.

As shown at 59 in FIGS. 2 and 3, adjustable stop means is provided on each of the mountings of the machines of FIGS. 12 and 13 for limiting the displacement of the tool heads in a vertical direction whereby the cutting depth of each cutting blades may be adjusted. The embodiments of FIGS. 12 and 13 will operate in a similar manner, making it possible to complete rail configuration operations rapidly so as to minimize dead track times and also reducing the number of operating personnel and operational planning requiring for such operations. When the rail contouring tools of each pair of mountings carry different cutting blades respectively designed for contouring the rail heads or planing corrugations in a single pass of the machine, the cutting blades may be optimally selected for cooperating so as to be best adapted for removal of the prevalent rail surface irregularities in a given track section. Each one of machines 1 may be used alone or a plurality of the machines may be coupled together into a work train.

The schematic illustrations of FIGS. 14 to 16 show machine 1 of FIG. 12 or the work train of FIG. 13 (which is functionally equivalent thereto) in operation when moved along track 7. A front pair of mountings, as seen in the operating direction, carries cutting blades 48 in an arrangement designed to plane overflow metal 34 at field sides 44 of rails 4 and 5, such a tool arrangement being illustrated in FIG. 5 (as applied to gage side 43). The succeeding pair of mountings carries pairs of cutting blades 48, 48 (see FIG. 7) for working in the manner of FIG. 15 while FIG. 16 shows the last pair of mountings with cutting blades 54 according to FIG. 8. In this manner, a single pass will produce not only removal of the overflow metal on the field sides of both rails but will also restore the outer half of the rails to their original profile. A second pass will then produce the same result on the other half of the rail heads.

FIG. 17 shows the work in a curve whose superelevation is illustrated in exaggerated form. Cutting blades 48 are so arranged with respect to respective rail heads 42 of rails 4 and 5 that the overflow metal at the inside of the curve of both rails is removed (see FIG. 5).

Remote control of all operations is possible by the provision of central power plant 14 and control 16 connected to the various drive means for vertically adjusting the mountings, for displacing the tool head in relation to the mounting and for laterally pressing the mountings against the rail heads. This enables rapid adjustments by a single operator and no further monitoring personnel need be used.

Those skilled in the art will appreciate that the present invention is not limited to the specific embodiments herein described and illustrated. Thus, the lateral guide rollers may have vertical axes extending not parallel to vertical center plane 55 of the rail heads but at an acute angle thereto. Their peripheries engaging the sides of the rail heads may take any desired configuration, including cylindrical, conical or differently curvilinear. The number of guide rollers may also differ from that shown and may be increased, for instance, for added adjustability of the reference basis. Furthermore, the various guides and drives for the tool head in horizontal and vertical directions may take any suitable form, as may the structure of the tool holder and the detachable mounting of the tool in the holder.

What is claimed is:

1. A mobile rail contouring machine mounted on a railroad track for continuous movement in an operating direction, the track including two rails each having a rail head defining a gage side, a field side and a running surface, the gage and field sides extending from the running surface to a lower edge of the rail head, the machine being arranged for continuously removing such running surface irregularities as ripples, corrugations and overflow metal during the continuous movement and comprising (a) a frame running on the track on undercarriages having flanged wheels engaging the gage and field sides in a zone adjacent the running surface, (b) a rail contouring tool mounting linked to the frame, (c) a drive means for vertically adjusting the mounting relative to the running surface of the rail head of one of the rails and for pressing the mounting thereagainst, (d) guide roller means for vertically and laterally guiding the mounting along said rail head without play, the guide roller means including (1) a guide roller laterally guiding the mounting along a selected one of the sides of the rail head and engaging the selected rail head side in a region extending from the lower edge to below the zone adjacent the running surface, and (2) two additional guide rollers vertically guiding the mounting along the running surface of said rail head, the additional guide rollers engaging the running surface and each having an axis extending substantially parallel to the track plane, (e) a rail contouring tool head including a tool holder, the tool head being mounted on the mounting for displacement in relation thereto and the tool holder including clamping means, and (f) a rail contouring cutting tool replaceably mounted in the clamping means of the tool holder, the tool holder detachably carrying (1) a cutting blade having a cutting edge for planing a selected profile of the rail head.

2. The mobile rail contouring machine of claim 1, wherein the two additional guide rollers are spaced apart in the direction of the track, a respective one of the guide rollers being associated with each one of the additional guide rollers, the guide rollers cooperating to constitute a rigid reference for planing the overflow metal at a side of said rail head opposite the selected side, and the rail contouring tool head being mounted on the mounting substantially centrally between the two additional guide rollers.

3. The mobile rail contouring machine of claim 2, wherein a respective pair of the guide rollers is associated with each additional guide roller, one of the guide rollers of each pair being arranged for laterally guiding the mounting along a respective one of the rail head sides.

4. The mobile rail contouring machine of claim 2 or 3, comprising further additional guide rollers spaced from each one of the additional guide rollers and including two outermost further additional guide rollers, the further additional guide rollers being mounted for selected positioning retracted from, and in engagement with, the running surface, the guide rollers cooperating in the engaged position to constitute an elongated rigid reference for planing ripples or corrugations.

5. The mobile rail contouring machine of claim 1 or 2, wherein the tool holder is symmetrically constructed with respect to a plane extending vertically to the track and perpendicularly to the rail whereby a respective one of the tools may be operative in a respective operating direction of the machine.

6. The mobile rail contouring machine of claim 1 or 2, wherein the tool holder has a guide, the tool has a part replaceably received by the guide, and clamping means holds the tool part attached to the guide.

7. The mobile rail contouring machine of claim 6, wherein the guide is a recess defined in the tool holder and extending in the direction of the track.

8. The mobile rail contouring machine of claim 7, wherein the recess is of dove-tailed cross section.

9. The mobile rail contouring machine of claim 1 or 2, wherein a single one of the mountings is linked to the machine frame in association with each rail, a single one of the tool heads is arranged on each mounting and a single one of the tools carrying a single one of the cutting blades is mounted in each tool holder, the mountings are in substantial alignment in a direction extending transversely to the rails, and further comprising transversely extending spacing members continuously adjustable to the track gage and linking the mountings to each other.

10. The mobile rail contouring machine of claim 9, comprising universal joints linking the spacing members to the mountings.

11. A train of three mobile rail contouring machines of claim 9, the machines being coupled together for common continuous movement, the rail contouring tool of each machine carrying a different one of the cutting blades respectively designed for contouring the rail head or planing corrugations in a single pass of the train.

12. The train of claim 11, further comprising adjustable stop means on each one of the machines for limiting the displacement of the tool head in a vertical direction whereby the cutting depth of each one of the cutting blades may be adjusted.

13. The mobile rail contouring machine of claim 1 or 2, comprising a plurality of the mountings linked to the machine frame in association with each rail, respective pairs of the mountings being in substantial alignment in a direction extending transversely to the rails, and transversely extending spacing members continuously adjustable to the track gage and linking the mountings of each pair to each other.

14. The mobile rail contouring machine of claim 13, further comprising adjustable stop means on each one of the mountings for limiting the displacement of the tool heads in a vertical direction whereby the cutting depth of each one of the cutting blades may be adjusted.

15. The mobile rail contouring machine of claim 13, wherein the rail contouring tools of each pair of mountings carry different ones of the cutting blades respectively designed for contouring the rail heads or planing corrugations in a single pass of the machine.

16. The mobile rail contouring machine of claim 1 or 2, further comprising a central power plant and a control mounted on the frame for remote control of the drive means for vertically adjusting the mounting.

17. The mobile rail contouring machine of claim 16, further comprising further drive means for displacing the tool head in relation to the mounting and for laterally pressing the mounting against the rail head, the central power plant and the control being arranged for remote control of the further drive means.

18. The mobile rail contouring machine of claim 17, wherein the central power plant includes a hydraulic fluid sump, the drive means are cylinder-piston motors and hydraulic fluid conduits connect the sump to the respective motor cylinders, the control being arranged in the conduits between the sump and the motors.

19. A mobile rail planing machine mounted on a railroad track for continuous movement in an operating direction, the track including two rails each having a rail head defining a gage side, a field side and a running surface, the gage and field sides extending from the running surface to a lower edge of the rail head, the machine being arranged for continuously removing such surface irregularities as ripples, corrugations and overflow metal during the continous movement and comprising (a) a frame running on the track on undercarriages having flanged wheels engaging the gage and field sides in a zone adjacent the running surface, (b) a rail planing tool mounting linked to the machine in association with each rail, (1) the mountings being in substantial alignment in a direction extending transversely to the rails, (c) transversely extending spacing members linking the mountings to each other, (d) hydraulic drives for continuously adjusting the spacing members and the mountings linked thereto the track, (e) hydraulic drive means for vertically adjusting the mountings relative to the running surface of the rail head of the associated rail and for pressing the mountings thereagainst, (f) guide roller means for vertically and laterally guiding the mountings along the rail heads of the associated rails, the guide roller means including (1) two guide rollers laterally guiding each mounting without play along a selected one of the sides of the rail head of the associated rail and engaging the selected rail head side in a region extending from the lower edge to below the zone adjacent the running surface, and (2) a plurality of additional guide rollers vertically guiding each mounting along the running surface of the rail head of the associated rail, the additional guide rollers engaging the running surface and each having an axle extending substantially parallel to the track plane, (g) a tool head including a tool holder, the tool head being mounted centrally between the guide rollers and for displacement in relation to the mounting in planes parallel to the track plane and to a vertical plane passing through the associated rail and the tool holder including clamping means, (h) further hydraulic drives connected to each tool head for displacing the same in said planes, (i) a rail planing tool replaceably mounted in the clamping means of the tool holder, the tool holder detachably carrying (1) a cutting blade having a cutting edge for planing a selected profile of the rail head.

* * * * *